US008863783B2

(12) United States Patent
Schwartz

(10) Patent No.: US 8,863,783 B2
(45) **Date of Patent: *Oct. 21, 2014**

(54) WATER FLOW RESTRICTION DEVICE AND METHOD

(71) Applicant: D.S. Magic Tech LLC, Lynbrook, NY (US)

(72) Inventor: David Schwartz, Woodmere, NY (US)

(73) Assignee: D.S. Magic Tech LLC, Lynbrook, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/036,420

(22) Filed: Sep. 25, 2013

(65) Prior Publication Data

US 2014/0034173 A1 Feb. 6, 2014

Related U.S. Application Data

(63) Continuation of application No. 13/251,727, filed on Oct. 3, 2011, now Pat. No. 8,567,445.

(51) Int. Cl.

| | |
|---|---|
| ***F15D 1/04*** | (2006.01) |
| ***E03C 1/00*** | (2006.01) |
| ***F15D 1/02*** | (2006.01) |
| *E03C 1/02* | (2006.01) |

(52) U.S. Cl.

CPC ..... *E03C 1/00* (2013.01); *E03C 2001/026* (2013.01); *F15D 1/04* (2013.01); *F15D 1/02* (2013.01); *E03C 1/021* (2013.01)

USPC ..... 138/44; 138/45; 239/533.1; 251/292; 137/385

(58) Field of Classification Search

CPC ..... F16L 55/027; F16L 55/04; F16K 47/10; G05D 7/012

USPC ..... 138/42–45; 137/860, 516.15; 239/553.14, 586, 570

See application file for complete search history.

(56) References Cited

U.S. PATENT DOCUMENTS

| | | | | | |
|---|---|---|---|---|---|
| 2,454,929 | A | * | 11/1948 | Kempton | 138/45 |
| 2,899,979 | A | * | 8/1959 | Dahl et al. | 138/45 |
| 2,936,788 | A | * | 5/1960 | Dahl et al. | 138/45 |
| 2,939,487 | A | * | 6/1960 | Fraser et al. | 138/45 |
| 3,409,050 | A | * | 11/1968 | Weese | 138/45 |
| 3,537,482 | A | * | 11/1970 | Rudewick | 138/44 |
| 3,642,031 | A | * | 2/1972 | Wright | 138/45 |
| 3,707,161 | A | * | 12/1972 | Crawford | 137/269 |
| 3,847,178 | A | * | 11/1974 | Keppel | 137/515.7 |
| 3,995,664 | A | * | 12/1976 | Nelson | 138/43 |
| 4,133,350 | A | * | 1/1979 | Nelson | 138/44 |

(Continued)

*Primary Examiner* — Patrick F Brinson

(74) *Attorney, Agent, or Firm* — Stern & Schurin LLP; Steven Stern, Esq.

(57) ABSTRACT

A device and method restricting water flow from a bathroom fixture is provided herewith. A preferred embodiment of the improved flow restrictor assembly comprises a metallic fitting or housing that accommodates an interior ring assembly and a flow-restrictor disk. The fitting is substantially tubular with a top section, a bottom section and an intersection. The top section of the fitting is defined by an opening, a hollow interior and a ledge upon which the interior ring assembly and flow-restrictor disk are positioned when the flow restrictor assembly is installed and in use. The bottom section features a pair of gripping planes which can be gripped by a specialized tool for purposes of uninstalling the improved flow restrictor assembly.

27 Claims, 11 Drawing Sheets

(56) References Cited

U.S. PATENT DOCUMENTS

| | | | | | |
|---|---|---|---|---|---|
| 4,244,526 | A | * | 1/1981 | Arth | 239/533.1 |
| 4,257,443 | A | * | 3/1981 | Turney | 137/269.5 |
| 4,562,960 | A | * | 1/1986 | Marty et al. | 239/72 |
| 4,785,847 | A | * | 11/1988 | Steer et al. | 303/9.62 |
| 4,867,198 | A | * | 9/1989 | Faust | 137/503 |
| 4,883,093 | A | * | 11/1989 | Miles et al. | 138/45 |
| 5,039,062 | A | * | 8/1991 | England et al. | 251/95 |
| 5,123,628 | A | * | 6/1992 | Yu | 251/209 |
| 5,315,859 | A | * | 5/1994 | Schommer | 73/1.25 |
| 5,404,904 | A | * | 4/1995 | Glaser | 137/539 |
| 5,899,224 | A | * | 5/1999 | Moldenhauer | 137/517 |
| 5,937,909 | A | * | 8/1999 | Clauss et al. | 138/43 |
| 6,390,134 | B1 | * | 5/2002 | Hanby | 138/44 |
| 6,571,831 | B1 | * | 6/2003 | Hart | 138/46 |
| 6,695,011 | B2 | * | 2/2004 | Sochtig | 138/43 |
| D529,130 | S | * | 9/2006 | Landolfi | D23/233 |
| 8,091,587 | B1 | * | 1/2012 | Schwartz | 138/44 |
| 2002/0189679 | A1 | * | 12/2002 | Avis et al. | 137/462 |
| 2004/0055364 | A1 | * | 3/2004 | Brewer | 73/40.5 R |

* cited by examiner

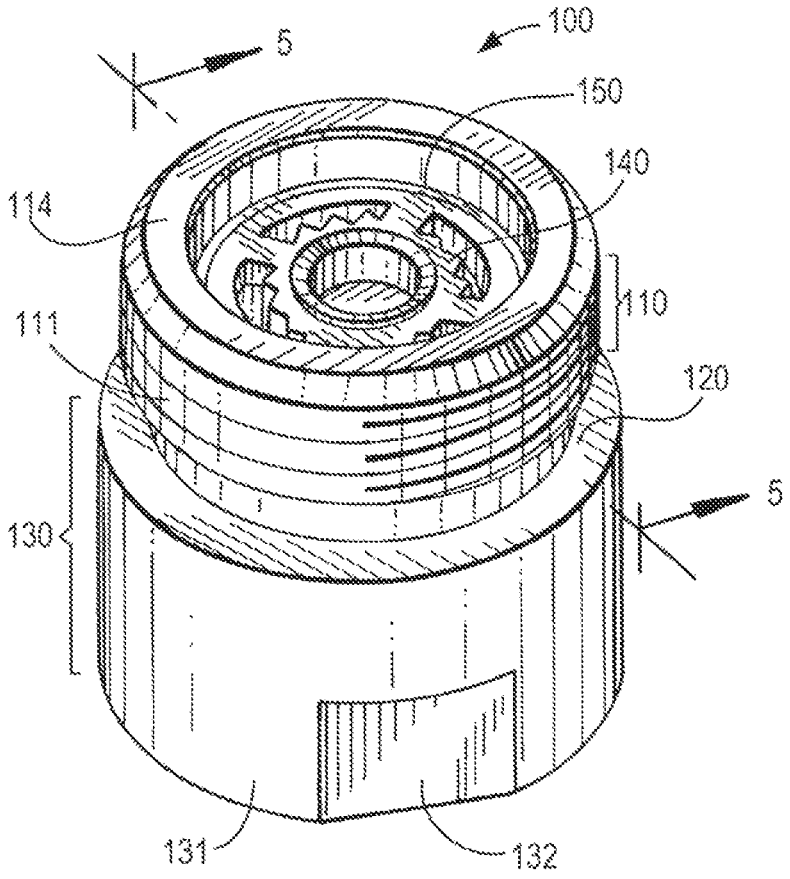
FIG. 1
FIG. 3
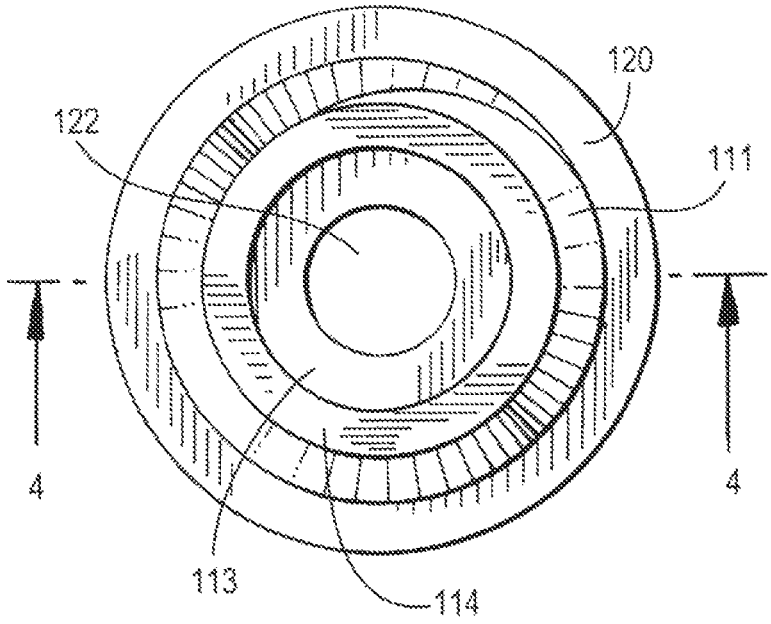

WATER FLOW RESTRICTION DEVICE AND METHOD

RELATED APPLICATION

This application is a continuation of application Ser. No. 13/251,727, filed on Oct. 3, 2011, now allowed, which is incorporated herein by reference.

FIELD OF INVENTION

The present application relates generally to a water flow restriction device and method. More specifically, the invention relates to an improved device and method for installing and preventing tampering with a flow restrictor assembly for restricting water flow to bathroom fixtures, such as a showerhead and bathtub faucet.

BACKGROUND OF THE INVENTION

A number of tools and systems are designed for use in connection with the task of resisting or reducing water flow in showerheads. The concern over global warming and the potential for drought in some areas continues to draw attention towards conserving water and energy. Water consumed through indoor and outdoor appliances represents a considerable share of a household's daily water usage in developed countries. Specifically, domestic use ranges from ten to thirty percent of overall water consumption in developed countries, with shower usage being typically the third largest water use in a residence.

In addition to environmental concerns, the Federal government through the Energy Policy Act of 1992, has mandated that many household fixtures must reduce water flow. In particular, all showerheads manufactured or imported into the United States must meet reduced flow requirements of 2.5 gallons per minute (gpm) at 80 pounds per square inch (psi). Prior to this regulation, shower users could consume five to eight gpm.

In order to conform to the federal regulations as well as reduce water and energy consumption, flow restrictors have been utilized in showerhead fixtures. These restrictors are simple disks with small openings, wherein the disks are either incorporated into the showerhead or manufactured as "after-market" inserts, installed at a point between the shower arm and the showerhead.

Despite its proposed utility, this device suffers from a number of deficiencies. For example, because of the configuration of these restrictors, a user may easily remove the disk, resulting in an increase in flow rate to a level that exceeds the 2.5 gpm maximum allowable flow rate. This problem is encountered by landlords in particular who typically must also endure the added water and heating costs without being able to pass those costs on to tenants.

Previous devices have attempted to provide an "after-market" tamper-resistant external flow restrictor using a rotating sleeve to cover the set screw that locks the fitting in place on the showerhead arm. The rotating sleeve of these devices is held in place by an additional screw set. However, a user could easily unscrew the screw holding the rotating sleeve in place, rotate the sleeve, and remove the second set screw in order to detach the flow restrictor from the showerhead arm.

One solution to remedy this problem is provided in U.S. application Ser. No. 12/657,838 ("Schwartz"). Schwartz discloses providing a flow restrictor concealed behind a shower wall and using a tamper-resistant fitting that is curved on all sides thereby hindering a user from utilizing any tool to unscrew the fitting. Instead, a knowledgeable worker must first remove the flow-restrictor disk from a fitting and insert a tool into a tool-hole hidden behind the flow-restrictor disk in order to completely remove the remaining portion of the flow-restrictor assembly. However, in order to optimize flow restriction, it is desirable for the flow-restrictor disk to always fit securely and tightly against all walls of the flow restrictor assembly. A flow-restrictor assembly that utilizes a flow-restrictor disk that can be dislodged in some manner to create a gap between the flow-restrictor disk and fitting within which it is positioned may decrease the effectiveness of the flow restrictor assembly and potentially lead to increased water usage. Furthermore, another deficiency in the prior art is the current water flow restrictor devices are designed solely for use along with a showerhead fixture, with no corresponding water flow restrictor device designed for use with bathtub fixtures. Because usage of a bathtub faucet is typically associated with filling a bathtub to a desired water level while the drain of the bathtub is blocked with a stopper, there appears to be no incentive to use of a flow restrictor device in a bathtub faucet. However, many use bathtub faucets for other purposes, such as running water for use in bathroom or household cleaning. In these situations, the drain stopper may be left open while water flows from the bathtub faucet. Thus, there is a need for a flow restrictor device to be used with a bathtub faucet.

SUMMARY OF THE INVENTION

In view of the deficiencies and drawbacks in the prior art, it is a primary object of the present invention to provide an improved water flow restriction device and method for use in connection with all bath fixtures in order to promote effective water flow restriction and reduction.

Another object of the present invention to provide an improved tamper-resistant water flow restriction device and method, which includes a tamper-resistant water flow restrictor concealed behind a shower wall.

Yet another object of the present invention is to provide a tamper-resistant water flow restriction device which includes a flow restrictor disk and a surrounding ring assembly to securely fit in a fitting thereby assuring that the flow restrictor remains in a fully operational position during water flow.

Another object of the present invention is to provide a water flow restriction device and method for use in connection with a bathtub fixture to reduce water flow.

Additional objectives will be apparent from the description of the invention that follows.

In summary, there is provided in a preferred embodiment of the present invention an improved flow restrictor assembly having a metallic fitting or housing that accommodates an interior ring assembly comprising a ring and a ring casing, and a flow-restrictor disk. Together, the interior ring assembly and flow-restrictor disk act as a flow regulator for regulating water flow. The fitting is substantially tubular with a top section and a bottom section, having a first opening and a second opening, respectively. The top section of the fitting is further defined by a hollow interior and a ledge upon which the interior ring assembly and flow-restrictor disk are positioned when the flow restrictor assembly is installed and in use. The bottom section of the fitting is formed with a substantially smooth and rounded outer surface. The bottom section further comprises a pair of gripping planes which can be gripped by a specialized tool for purposes of uninstalling the improved flow restrictor assembly.

There is also provided an improved method for restricting the flow of water and reducing water flow in the context of bath fixtures, and in particular bathtub fixtures. The method comprises the steps of providing an improved flow restrictor assembly and installing the assembly between the water supply line and bathtub faucet, preferably behind the shower wall.

Additional features of the invention are described below in more detail.

BRIEF DESCRIPTIONS OF THE DRAWINGS

The above-described and other advantages and features of the present disclosure will be appreciated and understood by those skilled in the art from the following detailed description and drawings of which FIG. 1 is a perspective view from the top of a flow restrictor assembly with a flow restrictor disk and ring assembly positioned within a flow restrictor fitting;

FIG. 3 is a top view of a flow restrictor fitting;

DETAILED DESCRIPTION OF THE INVENTION

Figure 2:
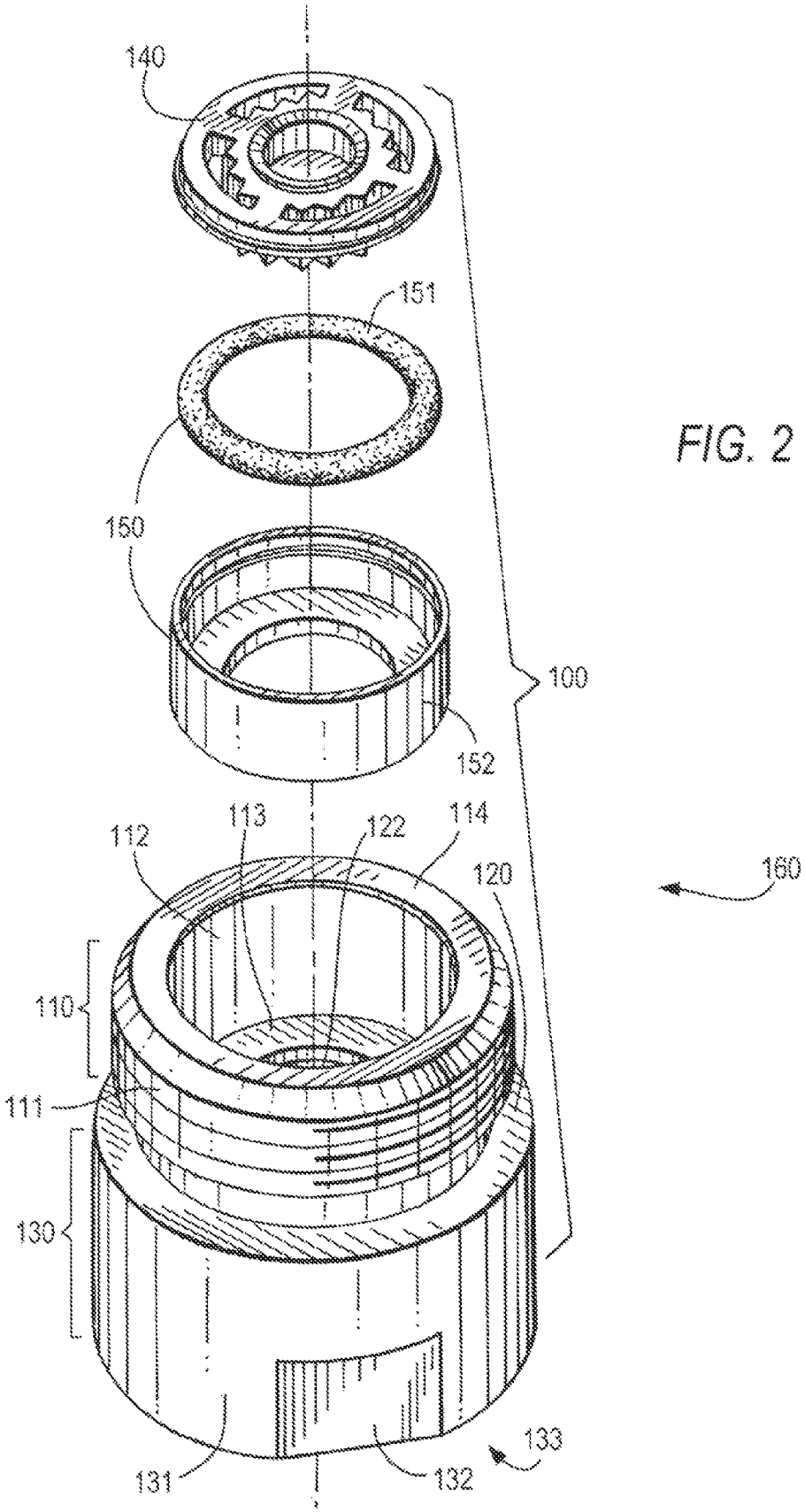
FIG. 2 is an exploded view of the flow restrictor assembly showing the flow restrictor fitting, ring casing, ring and flow restrictor disk.

With reference to FIGS. 1 through 12, there is shown a preferred embodiment of a system and method of installation of a flow restrictor device or assembly 100 of the present invention. Generally, the flow restrictor assembly contains a fitting 160 comprising a top section 110, a bottom section 130 and an intersection 120 at which the top section 110 meets the bottom section 130. In a preferred embodiment, the fitting 160 of the flow restrictor device 100 is formed of a metal or alloy, such as brass or copper. However, it should be understood that other metals, alloys or materials may be used as well.

As shown in FIGS. 1 and 3, the top section 110 of the flow restrictor device 100 is a cylindrically shaped portion, surrounded by an exterior screw thread 111, which is open at the top to produce an upper edge portion 114. The top section 110 is hollow along the inside forming a cylindrically shaped interior or cavity 112 adapted to receive a flow restrictor disk 140 and interior ring assembly 150. The interior ring assembly 150 and flow restrictor disk 140 combine to form a flow regulator. The base of the top section 110 includes an interior ledge 113 which directly supports the interior ring assembly 150 and the flow restrictor disk 140 therein. The interior ledge 113 contains a rounded aperture 122 which continues through the intersection 120 of the flow restrictor device 100.

The bottom section 130 of the flow restrictor device 100 is substantially cylindrical in shape and meets the top section 110 at the intersection portion 120. The base of the bottom section 130 makes up an open second end 133 of the flow restrictor device 100 whereby the open second end 133 is curved on the inside forming a rounded inside edge 135. The exterior of the bottom section 130 is substantially curved to create an outside rounded surface 131 with the exception of at least two gripping planes 132, 132 that are rounded on the inside edge 135 and flat on the exterior. The gripping planes 132, 132 are preferably located opposite each other along the circumference of the open second end 133.

FIG. 2 illustrates an exploded view of the flow restrictor assembly 100 with the flow restrictor disk 140 separated from ring 151 and ring casing 152. The flow restrictor disk 140 comprises a perimeter with interior spaces through which water may flow at a reduced flow rate. The sizes of the spaces generally dictate the desired flow. The ring 151 and ring casing 152 come together to form the interior ring assembly 150, wherein the ring 151 fits within the casing 152, having a diameter that approximates that of the ring casing 152. The relative dimensions of the casing 152 and ring 151 allow the ring 151 to be manually removed by a user if needed, but otherwise enables it to stay in place. The flow restrictor disk 140 is securely held above the ring 151 and within the ring casing 152. In a preferred embodiment the restrictor disk 140 and ring casing 152 are formed of a resilient plastic material, while the ring, which functions like a gasket, is formed of a more flexible material.

Notably, it is possible to form a somewhat larger flow restrictor disk to fit snugly within the top section of the fitting 160, without an interior ring assembly 150. A larger disk can be utilized without the interior ring assembly 150 to restrict water flow entering from a water supply line. However, differences in water pressure may result in different flow rates. Accordingly, it is desirable to utilize a regulator having a restrictor disk and an interior ring assembly which should limit water flow to a particular flow rate, regardless of differences in water pressure.

Figure 4:
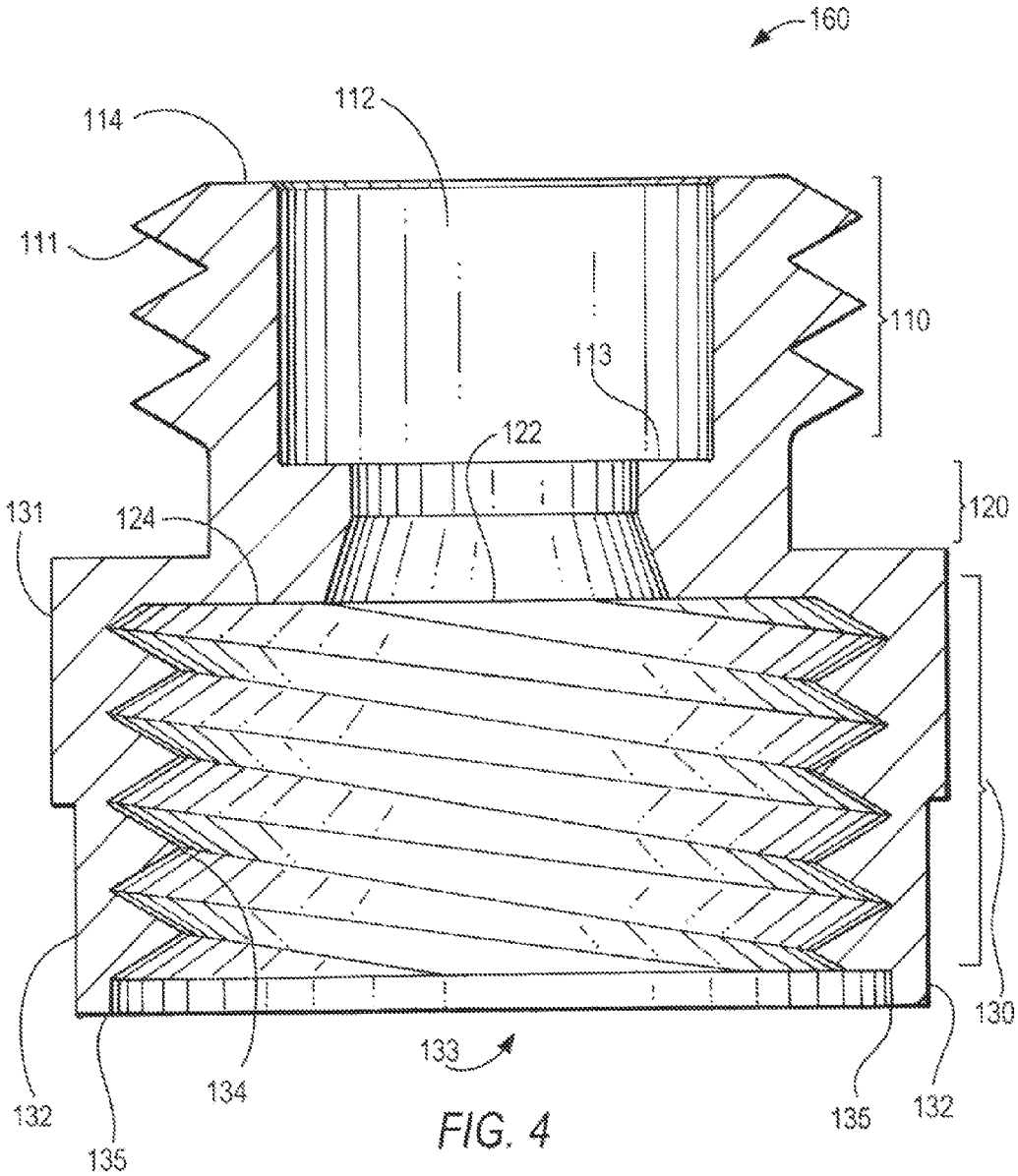
FIG. 4 is a cross-sectional view of a flow restrictor fitting taken along lines 4-4 of FIG. 3.
Figure 5:
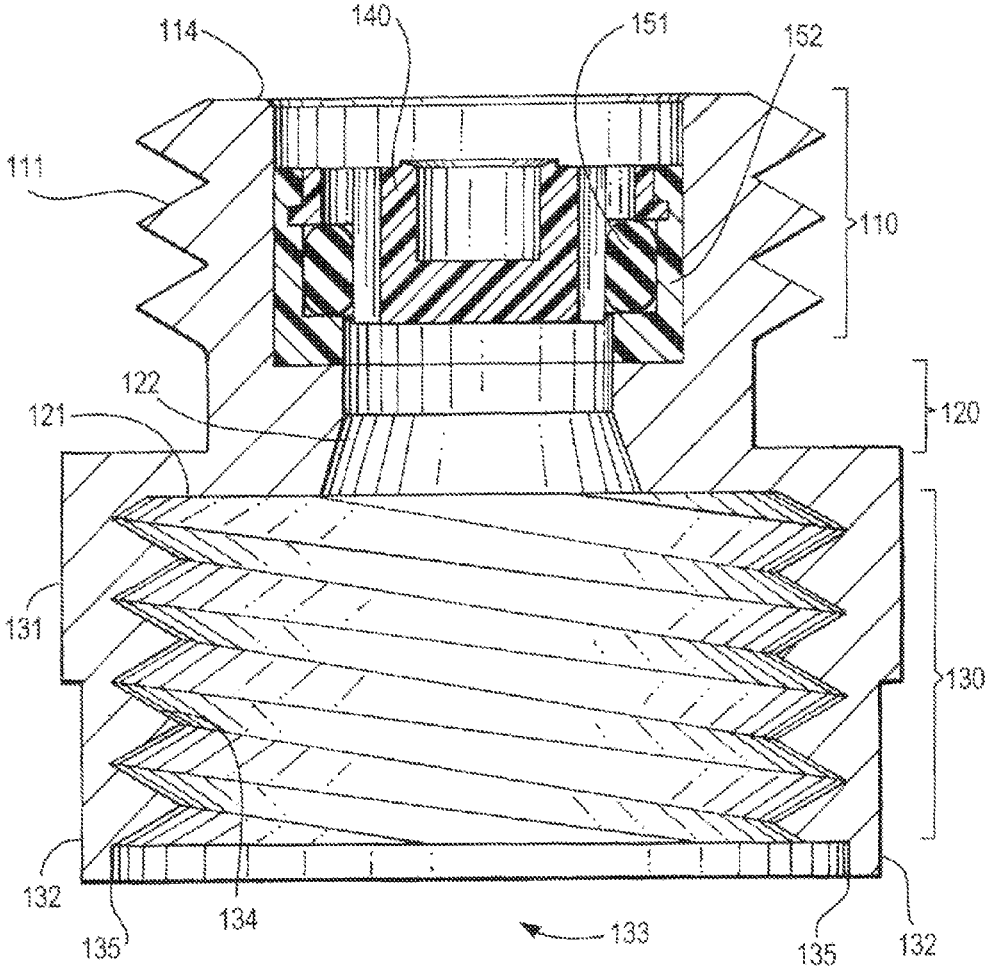
FIG. 5 is a cross-sectional view of a flow restrictor assembly with a flow restrictor disk and ring assembly positioned within the top section of the flow restrictor fitting.

FIGS. 4 and 5 show cross-sectional views of the flow restrictor fitting 160. FIG. 4 illustrates the fitting 160 without the flow restrictor disk 140 and interior ring assembly 150. FIG. 5 includes a cross-sectional view of the flow restrictor disk 140 and interior ring assembly 150. The fitting 160 is shaped such that the flow restrictor disk 140 and interior ring assembly 150 are received by the fitting 160 and fit snugly within the cylindrically shaped interior 112 and upon the interior ledge 113 of the top section 110. The intersection 120 contains a rounded hole 112 which is positioned below the interior ring assembly 150 and ends at the bottom section 130 creating an intersection wall 121. When the flow restrictor assembly is in use, water passes through the spaces in the flow restrictor disk 140, through the bottom of the interior ring assembly 150, through rounded hole 112 and then onward eventually to the fixture.

The interior ledge 113 of the top section 110 and the surrounding interior space 112 illustrated in FIG. 4 provides continuous support for the flow restrictor disk 140 and ring assembly 150 as illustrated in FIG. 5. The presence of the ledge blocks movement of the assembly 150 and disk 140 in the direction of water flow. This snug fitting and corresponding dimension of the parts allow the flow restrictor 140 and ring assembly 150 to remain in place throughout use without tumbling, turning to one side or becoming dislodged, particularly when the flow of water alternates repeatedly such as when a user turns on the water, turns off the water or otherwise varies its flow.

Figure 6:
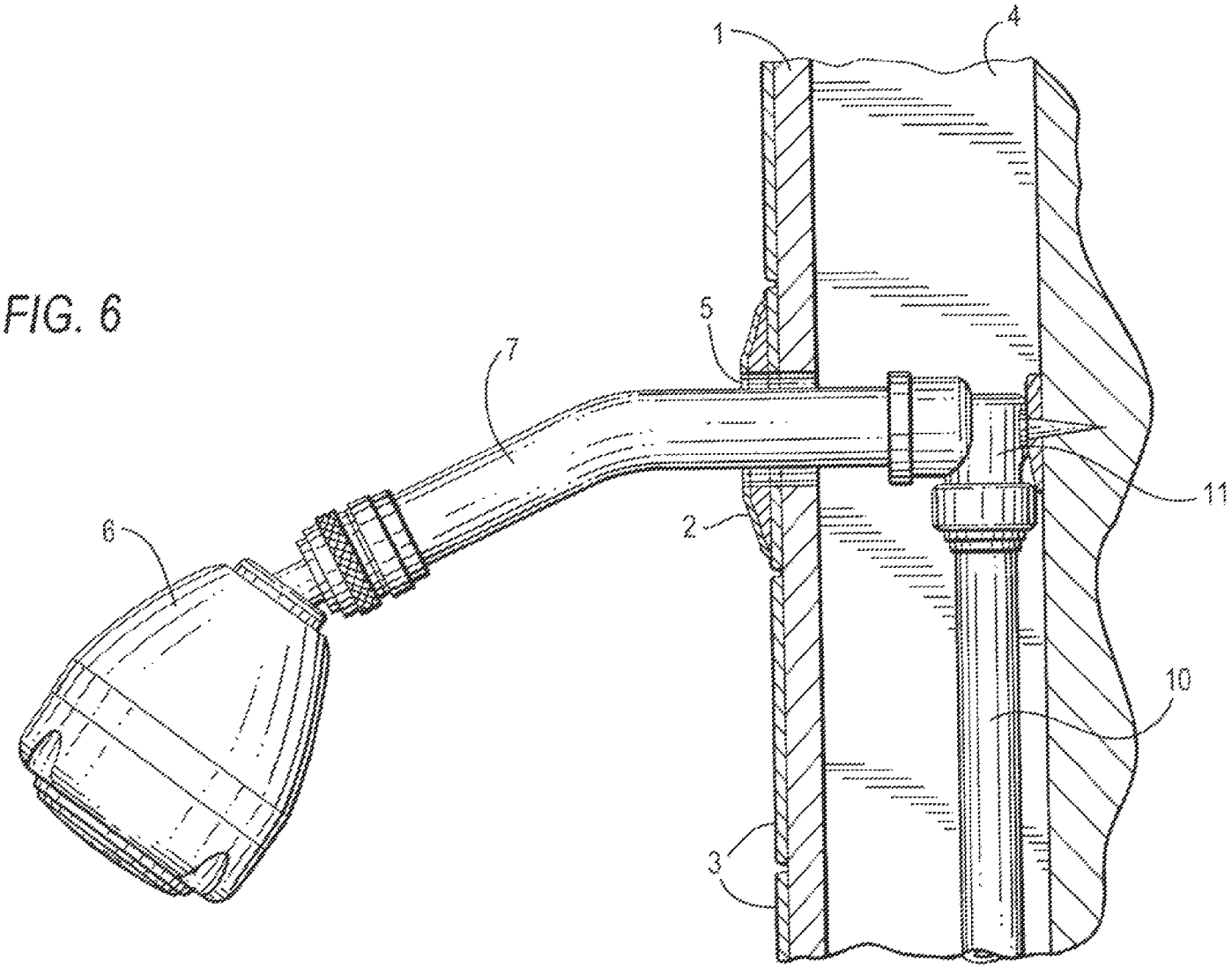
FIG. 6 is a side elevational view of a conventional showerhead installation with a cross-sectional view of a shower wall.

FIG. 6 illustrates a prior art example of a showerhead arm 7 coupled with a showerhead 6 connected to a water supply line 10. The showerhead arm 7 extends beyond a cover plate 2 that conceals an opening 5 into a cavity 4 of a shower wall 1. Inside the cavity 4 of the shower wall 1, the showerhead arm 7 is preferably connected to an elbow 11 that attaches a water supply line 10 to the showerhead arm 7. The elbow 11 functions as an access point to redirect the flow of water from an upward vertical direction to a horizontal direction, making the water supply available through an opening 5 in the shower wall 1.

FIGS. 7 through 11 illustrate the installation and/or removal of the flow restrictor device 100. While the installation and removal depicted is of a showerhead, the same installation and removal process may be used for all bath fixtures, including, for example, a bathtub faucet.

Figure 7:
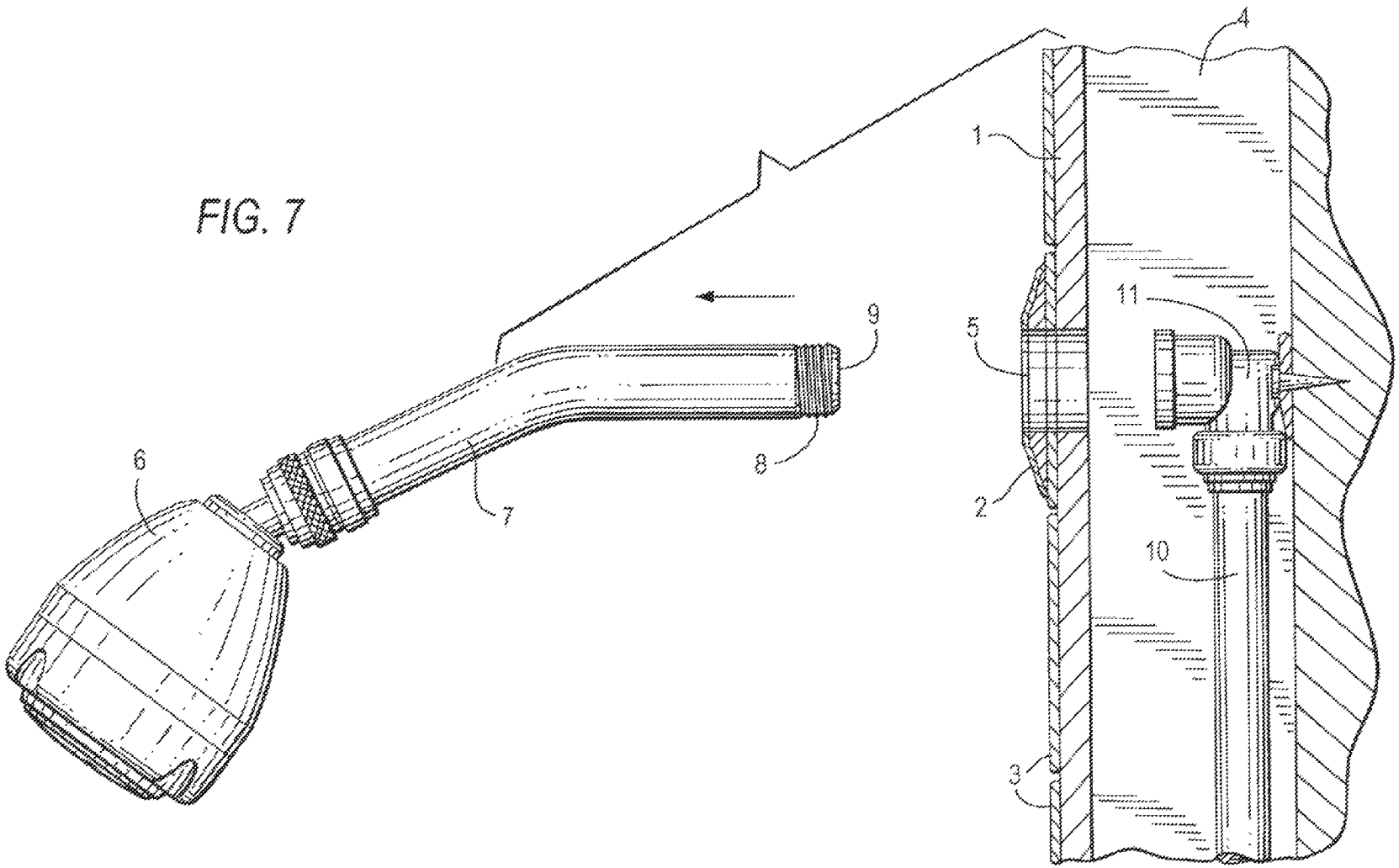
FIG. 7 is a side elevational view of a conventional showerhead installation showing a showerhead arm disconnected from an elbow that connects to a water supply line.

FIG. 7 first shows the removal of the showerhead arm 7 coupled with a showerhead 6 from the elbow 11 that is connected to the water supply line 10. The elbow 11 contains an internally threaded opening (not shown) in the horizontal direction. The showerhead arm 7 disconnects from the elbow 11 by unscrewing the external thread 8 of the second end 9 of the showerhead arm 7 from the internal thread of the elbow 11. Although it is possible to remove the cover plate 2 during installation, it does not necessarily have to be removed in order to connect or disconnect the showerhead arm 7 as the cover plate 2 has an opening that allows the showerhead arm 7 to extend beyond and pass through the shower wall 1. This allows the second end 9 of the showerhead arm 7 to remain concealed behind the cover plate 2 when installed.

Figure 8:
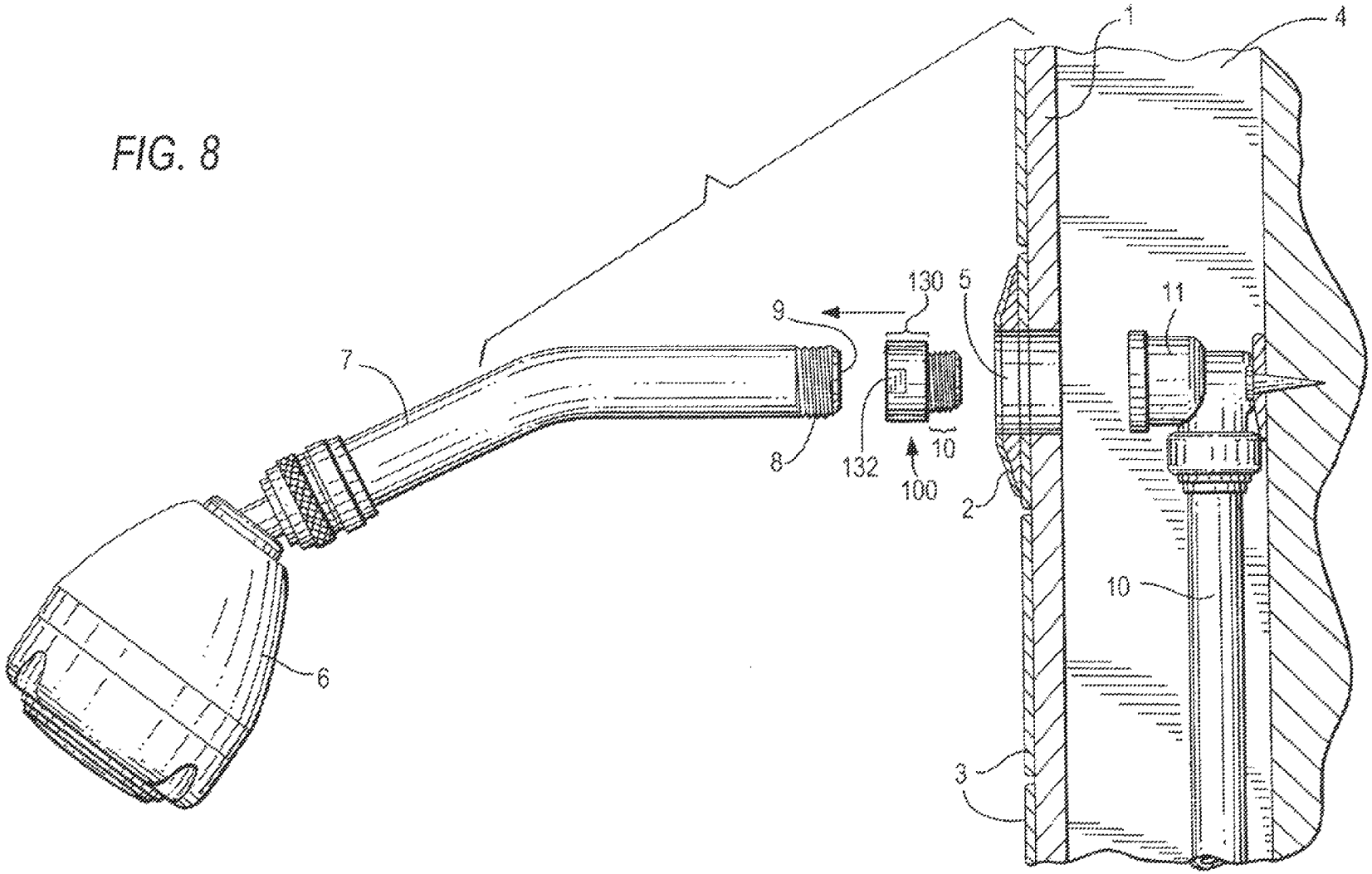
FIG. 8 is a side elevational view of a showerhead arm and the flow restrictor assembly prior to installation.

FIG. 8 shows the flow restrictor device 100 placed between the showerhead arm 7 and the elbow 11. The external thread 111 on the top section 110 of the flow restrictor device 100 may be screwed into the internal threading of the elbow 11. The external thread 8 of the showerhead arm 7 screws into the interior screw thread 134 of the bottom section 130 of the flow restrictor device 100. In this manner, the flow restrictor device 100 may be installed between the showerhead arm 7 and the elbow 11. Further, once installed, the flow restrictor assembly may be concealed behind the cover plate 2 of the shower wall 1 as illustrated in FIG. 9.

Figure 9:
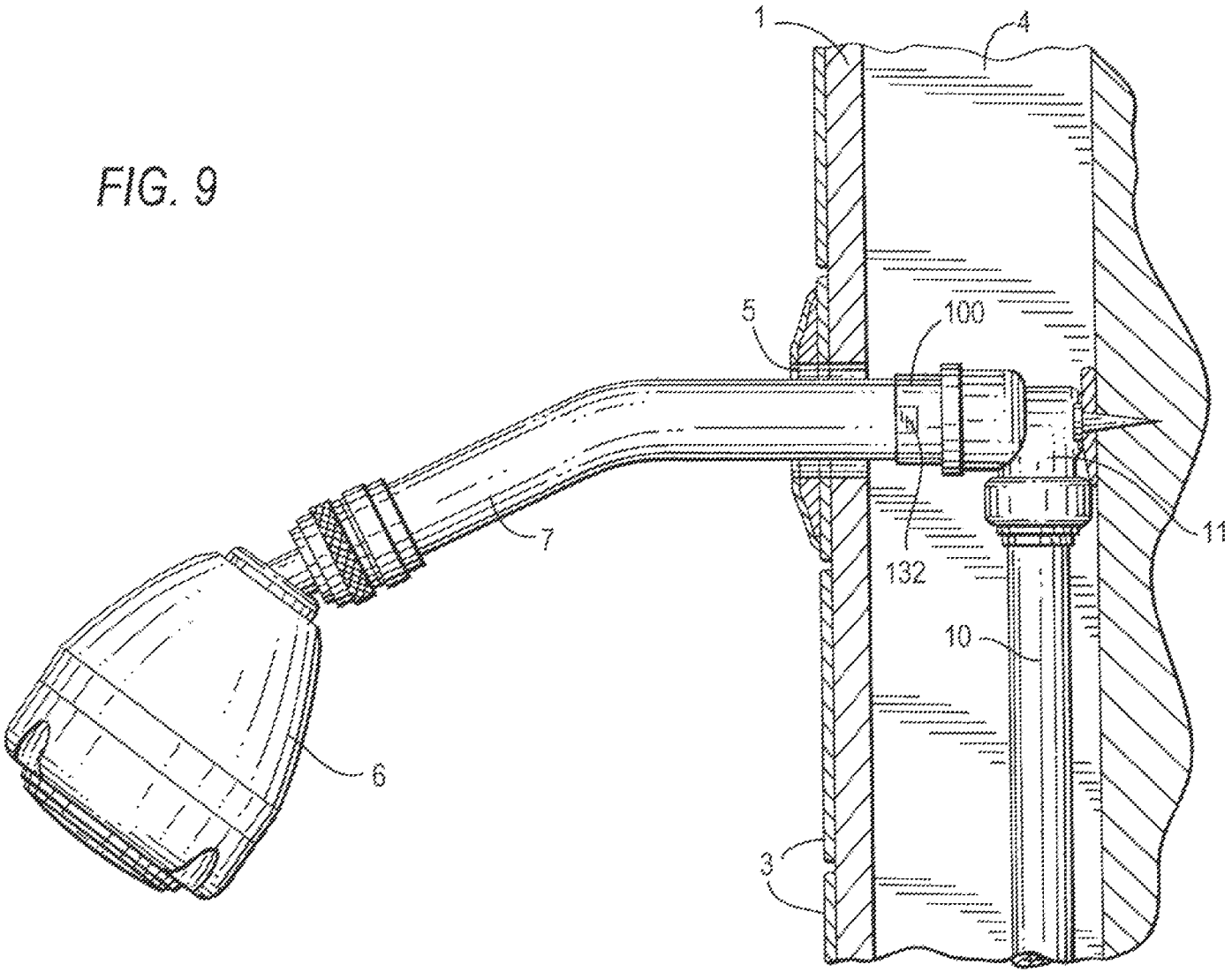
FIG. 9 is a side elevational view of a showerhead arm with the flow restrictor assembly installed.

FIG. 9 demonstrates an assembled flow restriction system including the flow restrictor device 100 and a portion of the showerhead arm 7 concealed behind the cover plate 2 of the shower wall 1. The flow restrictor device 100 and the showerhead arm 7 are capable of being attached to the elbow without removal of the cover plate 2 as the flow restrictor assembly 100 and showerhead arm 7 are extendable through an opening 5 of the shower wall 1.

Figure 10:
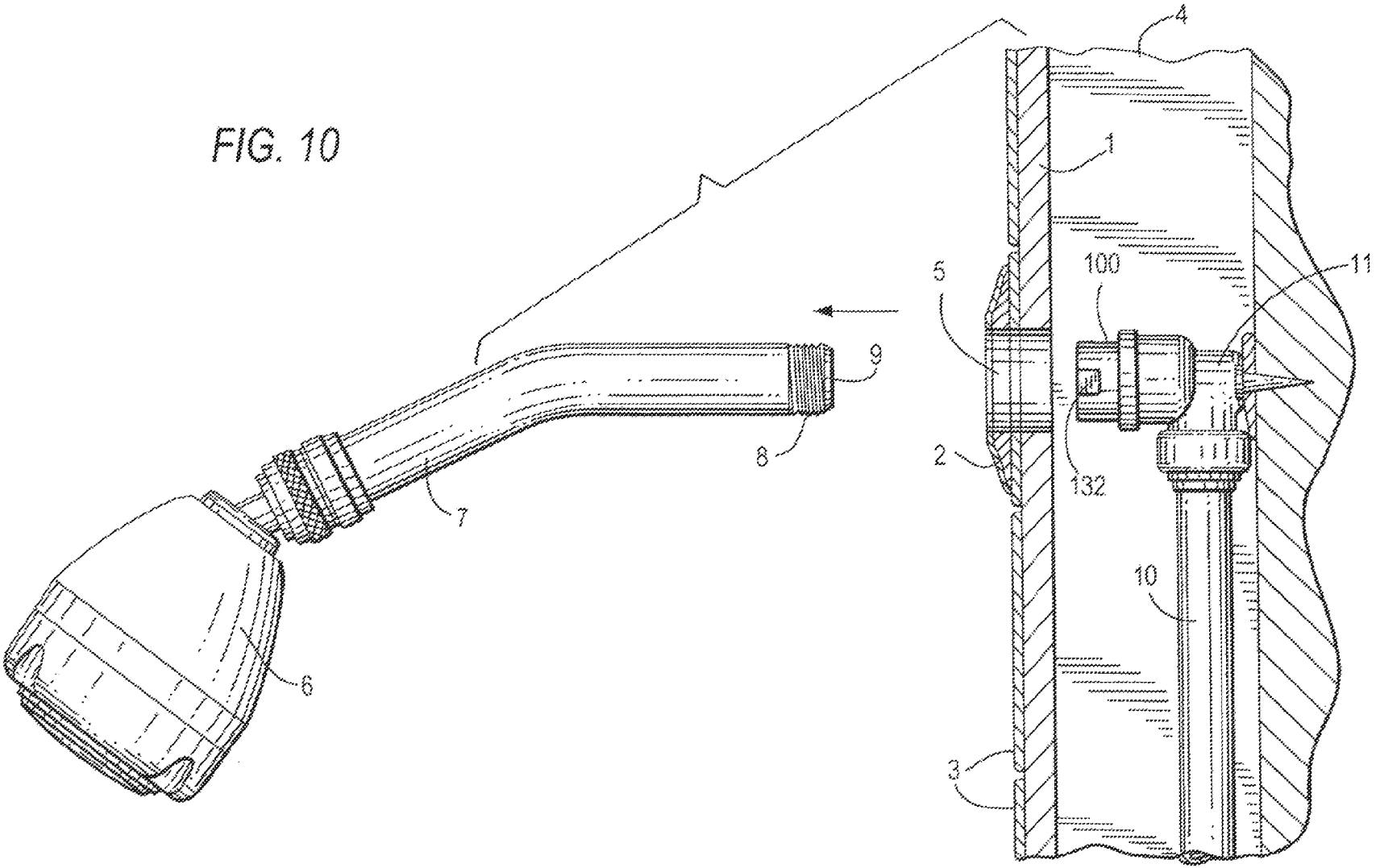
FIG. 10 is a side elevational view of a showerhead arm detached from the flow restrictor assembly during removal.

FIG. 10 illustrates the removal of the showerhead arm 7 from the flow restrictor device 100, leaving the flow restrictor device 100 screwed into the elbow 11 of the water supply line 10. The flow restrictor device 100 remains behind the shower wall 1 and can only be accessed with a specialized tool 12 that can extend beyond the shower wall 1 through an opening 5 as demonstrated in FIG. 11.

Figure 11:
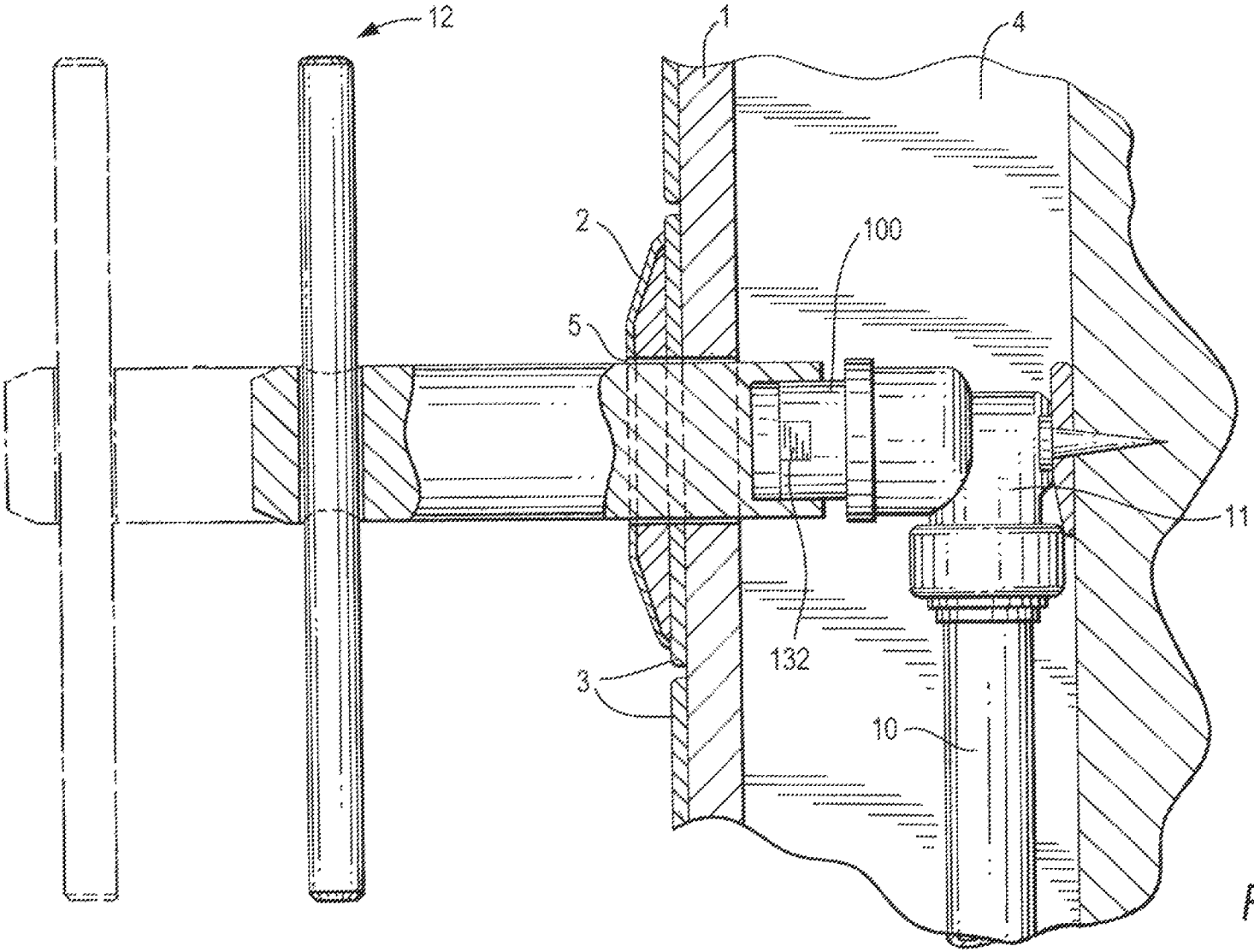
FIG. 11 is a cross-sectional view of a shower wall with a tool engaging an installed flow restrictor assembly.

To remove the flow restrictor device 100, a specialized tool 12, shown in FIG. 11, is provided to engage gripping planes 132 on the outside surface 131, which are hidden behind the shower wall 1. Once the gripping planes 132 are engaged with the tool 12, the flow restrictor device 100 may be unscrewed from the elbow 11. Significantly, since the intersection wall 121 of the fitting 160 partially conceals and hinders physical access to the flow restrictor disk 140 and interior ring assembly 150, it is difficult for a user to even notice the flow restrictor disk 140 without first removing the entire flow restrictor assembly 100. Without noticing the presence of the restrictor disk 140, a user will likely not even attempt to engage in its removal. By the same token even after noticing the presence of a restrictor disk 140, a user may not attempt to engage in its removal after recognizing that it will be a difficult process.

It should be understood that the rough opening 5 in the shower wall 1 has minimal clearance due to a plurality of tiles 4 with grout filling that often surround the opening 5. Thus, the opening 5 would be somewhat irregular as determined by the trimming skill of the tiler and would require a specific tool 12 to engage the gripping planes 132.

The arrangement of the system shown in FIG. 9, and the process of removal of the flow restrictor device 100 demonstrated in FIGS. 10 and 11 illustrates one way in which a user is prevented from removing the flow restrictor device 100. A user may desire to remove the flow restrictor device 100, and perhaps a user may even attempt to employ the use of pliers or the like in an effort to remove the flow restrictor device 100. However, because the flow restrictor device 100 is hidden behind the shower wall 1, and the opening 5 has minimal clearance, there is typically not enough space to allow a pair or pliers or the like to pass in order to grip the gripping planes 132. Instead, as FIG. 11 illustrates, a specialized tool 12 in the form of a cylindrically-shaped tube with flattened end portions to engage the gripping planes 132, is needed in order to pass through the minimal clearance provided by the opening 5 and grip the gripping planes 132. It should be understood that other similar tools may be formed or utilized with the same goal and to accomplish the same function as provided by specialized tool 12.

Figure 12:
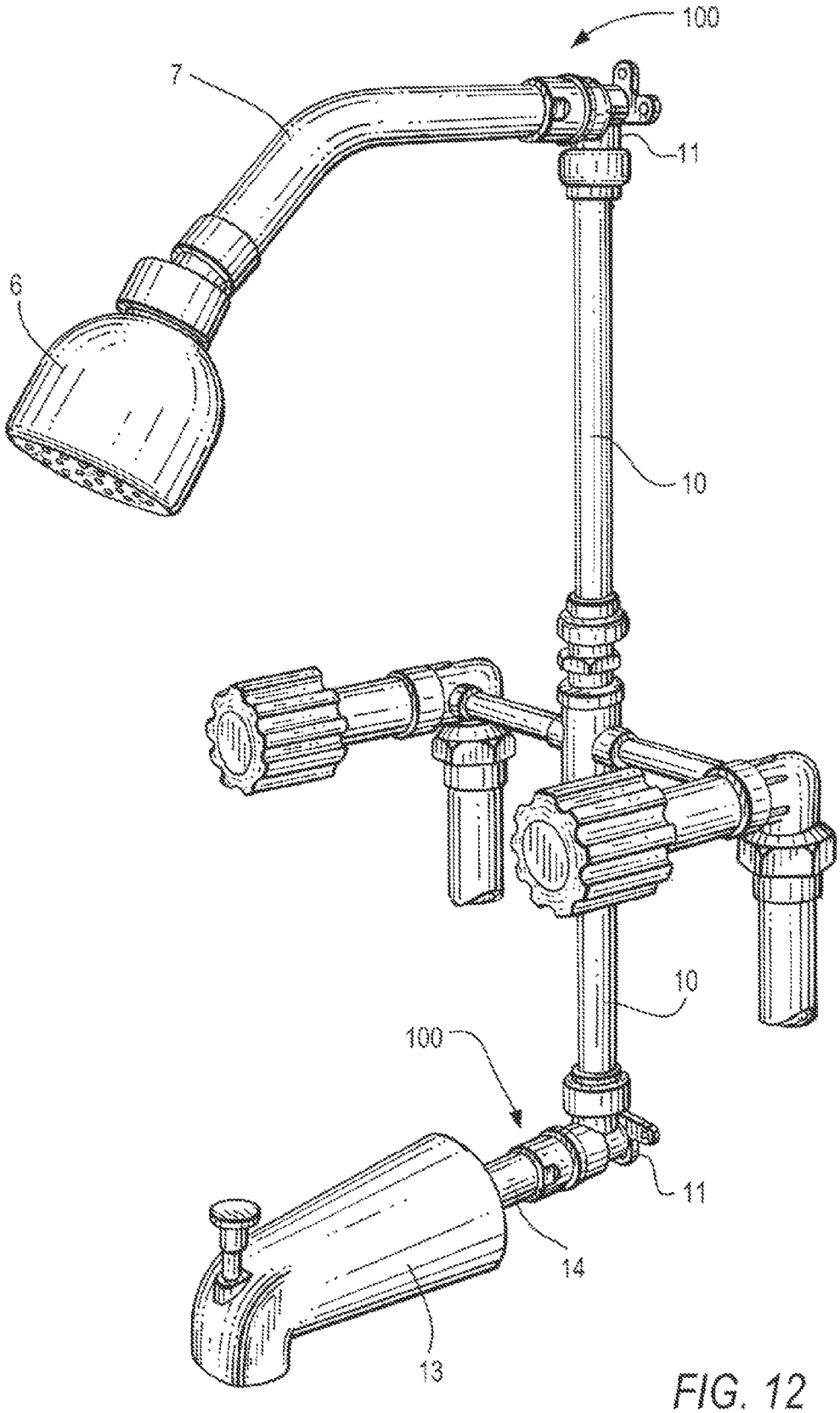
FIG. 12 is a perspective illustration of a water flow restriction system including a showerhead fixture coupled with a flow restrictor assembly and a bathtub faucet coupled with a flow restrictor assembly.

FIG. 12 illustrates an example of a full bath fixture system including a showerhead 6 coupled with a showerhead arm 7 as well as a bathtub faucet 13 coupled with a faucet arm 14. Both the showerhead arm 7 and faucet arm 14 are each attached to a flow restrictor device 100, resulting in reduced water flow from the water supply line 10 that is connected to the both the bathtub faucet 13 and the showerhead 6. It should be understood that different flow restrictor disks may be used to allow for different flow rates as desired. For example, a flow restrictor disk allowing a flow rate of 2.5 gpm may be used in connection with water leaving out of the bathtub fixture while, at the same time, using a flow restrictor disk allowing a flow rate of 1.8 gpm for water leaving out of the showerhead fixture.

The accompanying drawings only illustrate a flow restrictor assembly, its constituent parts, and method of use. However, other types and styles are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first," "second" and similar terms may be used herein to modify various elements. These modifiers do not imply a spatial, sequential, or hierarchical order to the modified elements unless specifically stated.

The invention claimed is:

1. A flow restrictor device, comprising:

a unitary fitting having a top section, a bottom section, and an interior cavity with a support ledge positioned within said interior cavity wherein said support ledge extends radially inward within said interior cavity; and a flow restrictor disk having a perimeter and interior spaces to allow water to pass at a reduced flow rate when said flow restrictor device is in use, said support ledge supporting said perimeter of said flow restrictor disk in said interior cavity.

2. The flow restrictor device of claim 1 further comprising an interior ring assembly, having a ring casing and a ring positioned in said ring casing, wherein said flow restrictor disk is positioned in said ring casing, substantially concealing said ring.

3. A flow restrictor device, comprising:

a fitting having a top section, a bottom section, and an interior cavity with a support ledge positioned within said interior cavity;

a flow restrictor disk having a perimeter and interior spaces to allow water to pass at a reduced flow rate when said flow restrictor device is in use, said support ledge supporting said perimeter of said flow restrictor disk in said interior cavity;

an interior ring assembly, having a ring casing and a ring positioned in said ring casing, wherein said flow restrictor disk is positioned in said ring casing, substantially concealing said ring;

wherein said interior ring assembly with said flow restrictor disk are positioned inside said interior cavity at said top section.

4. The flow restrictor device of claim 3 wherein said interior ring assembly and said interior cavity each have respective dimensions that enable said interior ring assembly to fit snugly within said interior cavity to prevent tumbling or dislodging of said interior ring assembly during water flow.

5. The flow restrictor device of claim 3 wherein said interior ring assembly with said flow restrictor disk are positioned inside said interior cavity against said ledge to prevent movement of the interior ring assembly and flow restrictor disk when water is in use.

6. A flow restrictor device, comprising:

a fitting having a top section, a bottom section, and an interior cavity with a support ledge positioned within said interior cavity; and a flow restrictor disk having a perimeter and interior spaces to allow water to pass at a reduced flow rate when said flow restrictor device is in use, said support ledge supporting said perimeter of said flow restrictor disk in said interior cavity;

wherein said top section has a diameter and an exterior surface that has threading corresponding to an interior threaded surface of an elbow attached to a water supply line.

7. The flow restrictor device of claim 6 wherein said elbow is positioned behind a wall.

8. The flow restrictor device of claim 1 further comprising a ring, said ring adapted to regulate water flow and positioned between said ledge and said flow restrictor disk.

9. A method of restricting water flow with a flow restrictor device comprising the steps of:

providing a flow restrictor device having (a) a top section, (b) a bottom section, (c) an interior cavity with a support ledge positioned within said interior cavity, and (d) a flow restrictor disk having a perimeter and interior spaces to allow water to pass at a reduced flow rate, wherein said support ledge supports said perimeter of said flow restrictor disk in said interior cavity;

attaching an arm to said bottom section of said flow restrictor device by rotating said arm in said bottom section; and installing said flow restrictor device in an access point to a water supply line behind a wall, wherein said top section of said flow restrictor device is inserted into said access point.

10. The method of claim 9 wherein said attaching step precedes said installing step.

11. The method of claim 9 wherein said installing step precedes said attaching step.

12. The method of claim 9 wherein said access point is an elbow.

13. The method of claim 9 wherein said arm is a bathtub faucet arm.

14. The method of claim 13 further comprising the step of attaching a bathtub faucet to said bathtub faucet arm.

15. The method of claim 9 wherein said arm is a shower arm.

16. The method of claim 15 further comprising the step of attaching a showerhead fixture to said shower arm.

17. A method of restricting water flow with a flow restrictor device comprising the steps of:

providing a flow restrictor device having (a) a top section, (b) a bottom section, (c) an interior cavity with a support ledge positioned within said interior cavity, and (d) a flow restrictor disk having a perimeter and interior spaces to allow water to pass at a reduced flow rate, wherein said support ledge supports said perimeter of said flow restrictor disk in said interior cavity;

attaching an arm to said bottom section of said flow restrictor device by rotating said arm in said bottom section; and installing said flow restrictor device in an access point to a water supply line behind a wall, wherein said top section of said flow restrictor device is inserted into said access point;

wherein when said flow restrictor device is installed in said access point, said flow restrictor disk is positioned opposed to said water flow such that said water forces said flow restrictor disk against said ledge.

18. A method for restricting water flow from an existing bath piping system comprising the steps of:

providing a flow restrictor device having (a) a unitary flow restrictor fitting comprising an internal cavity, a bottom section with an interior threaded surface, a top section with an exterior threaded surface, and a ledge dividing said top section and said bottom section, and (b) a flow restrictor disk positioned against said ledge of said flow restrictor fitting, installing said flow restrictor device in an access point to a water supply line behind a wall, wherein said top section of said flow restrictor fitting is inserted into said access point; and attaching an arm to said bottom section of said flow restrictor fitting by rotating said arm in said bottom section.

19. The method of claim 18 wherein said attaching step precedes said installing step.

20. The method of claim 18 wherein said installing step precedes said attaching step.

21. The method of claim 18 wherein said access point is an elbow.

22. The method of claim 18 wherein said arm is a bathtub faucet arm.

23. The method of claim 22 further comprising the step of attaching a bathtub faucet to said bathtub faucet arm.

24. The method of claim 18 wherein said arm is a shower arm.

25. The method of claim 24 further comprising the step of attaching a showerhead fixture to said shower arm.

26. A method for restricting water flow from an existing bath piping system comprising the steps of:

providing a flow restrictor device having (a) a unitary flow restrictor fitting comprising an internal cavity, a bottom section with an interior threaded surface, a top section with an exterior threaded surface, and a ledge dividing said top section and said bottom section, and (b) a flow restrictor disk positioned against said ledge of said flow restrictor fitting, installing said flow restrictor device in an access point to a water supply line behind a wall, wherein said top section of said flow restrictor fitting is inserted into said access point; and attaching an arm to said bottom section of said flow restrictor fitting by rotating said arm in said bottom section, wherein said top section of said internal cavity of said flow restrictor device is asymmetrical relative to said bottom section.

27. The method of claim 18 wherein when said flow restrictor device is installed in said access point, said flow restrictor disk is positioned opposed to said water flow such that said water forces said flow restrictor disk against said ledge.

* * * * *